United States Patent [19]

Sutherland

[11] 4,178,697

[45] Dec. 18, 1979

[54] CONDENSATION CHAMBER FOR FREEZE DRYING APPARATUS

[75] Inventor: David T. Sutherland, Woodstock, N.Y.

[73] Assignee: The Virtis Company, Gardiner, N.Y.

[21] Appl. No.: 890,976

[22] Filed: Mar. 28, 1978

[51] Int. Cl.[2] ..... F26B 13/30

[52] U.S. Cl. ..... 34/92; 55/82; 62/93

[58] Field of Search ..... 55/82; 62/93; 34/92

[56] References Cited

U.S. PATENT DOCUMENTS

| | | | |
|---|---|---|---|
| 2,519,028 | 8/1950 | Dodge | 62/93 |
| 2,935,856 | 5/1960 | Gifford | 62/93 |
| 3,271,874 | 9/1966 | Oppenheimer | 34/5 |
| 3,286,366 | 11/1966 | Seligman | 34/92 |
| 3,795,986 | 3/1974 | Sutherland | 34/92 |
| 3,950,963 | 4/1976 | Sutherland | 34/92 X |
| 4,090,312 | 5/1978 | Fraser | 34/92 |

FOREIGN PATENT DOCUMENTS 1000545 of 1962 United Kingdom ..... 34/92

*Primary Examiner*—John J. Camby

*Attorney, Agent, or Firm*—Kirkland & Ellis

[57] ABSTRACT

A condensation chamber for freeze drying apparatus is designed such that moisture containing air evacuated from a drying chamber passes substantially uniformly over the cooled interior surfaces of the condensation chamber thereby maximizing the available surface for moisture condensation and freezing. This desirable result is achieved by a tube which is connected to a vacuum pump and positioned through an end wall of the condensation chamber along the central axis of the chamber. One open end of the tube is positioned adjacent one end wall of the chamber and openings are provided through the wall of the tube adjacent the other end wall so that moisture containing air entering the chamber intermediate of the openings in the tube travel in both directions along the cooled interior surfaces of the chamber toward both openings in the tube.

4 Claims, 2 Drawing Figures

CONDENSATION CHAMBER FOR FREEZE DRYING APPARATUS

BACKGROUND OF THE INVENTION

1. Field of the Invention

The present invention relates generally to freeze drying apparatus, and more particularly, this invention relates to an improved condensation chamber for freeze drying apparatus.

2. Description of the Prior Art

The method of freeze drying biological specimens and other materials such as coffee and other food products by sublimation of ice in a vacuum has been known for over 50 years. It was not until shortly before World War II, however, that the true commercial potential of laboratory freeze dryers and the process of sublimation were recognized. Particularly, during World War II, substantial development was made in the equipment and techniques for the purposes of supplying medical products to the armed forces. Since that time, increased interest by food processors as well as pharmaceutical manufacturers has resulted in further development of freeze drying equipment. Thus, freeze drying has found application not only in the laboratory for various scientific purposes, but commercially as well.

Basically, the process of freeze drying involves the lowering of the temperature of a moisture-containing item or sample until it is in a completely solid state, i.e., until it is frozen. The sample is then maintained in the area of a very low absolute pressure or high vacuum and subjected to a controlled heat input. Application of the heat to the product at a controlled rate results in the water content of the frozen sample being sublimated (i.e., converted directly from a solid to a gas without passing through the liquid state). The gaseous water vapor is then evacuated from the drying chamber and refrozen in a refrigerated condensation chamber thereby protecting the vacuum pump oil from contamination by the water vapor. The refrozen moisture can be removed from the condensation chamber when the chamber is filled.

Various types of freeze drying equipment are well known in the art as exemplified by the apparatus disclosed in U.S. Pat. Nos. 3,950,963-Sutherland and 3,795,986-Sutherland et al., both of which are assigned to the same assignee as the present invention. Since the capabilities of such freeze drying equipment are dependent upon the amount of moisture that may be removed from the moisture-containing item being dried, it is desirable to maximize the moisture-removing capabilities of the equipment. The moisture-removing capabilities of the equipment are to a great extent determined by the capabilities of the condensation chamber to condense and freeze the moisture removed from the item. Thus, it is a desirable advance in the art to maximize the capabilities of the condensation chamber in freeze drying equipment so that the maximum available volume of the condensation chamber is utilized to refreeze the sublimated moisture.

BRIEF DESCRIPTION OF THE INVENTION

The present invention is an improvement for apparatus for freeze drying moisture-containing items. Such freeze drying equipment or apparatus typically includes a sealable vacuum tight drying chamber for holding the moisture containing item, a hollow vacuum type condensation chamber communicating with the drying chamber, a means for supplying heat to the drying chamber, a vacuum pump communicating with the condensation chamber for evacuating air from the drying chamber through the condensation chamber, a refrigeration compressor and refrigeration coils connected to the refrigeration compressor and positioned around the condensation to cool the hollow interior of the condensation chamber.

The improvement of the present invention comprises means for causing the air evacuated from the drying chamber to flow over the entire cooled hollow interior of the condensation chamber substantially uniformly so that moisture sublimated from the moisture-containing object will refreeze substantially uniformly on the hollow interior of the condensation chamber. Maximized moisture removal for the condensation chamber volume can thereby be achieved before there is a necessity for removing the frozen moisture from the condensation chamber.

More specifically, the improved condensation chamber in accordance with the present invention comprises a cylindrical side wall, a circular end wall sealing one end of the cylindrical side wall, and a removable cover sealing the other end of the cylindrical side wall. The condensation chamber communicates with the drying chamber through a port through the cylindrical side wall intermediate of the ends thereof. Refrigeration coils are positioned around the cylindrical side wall to cool the cylindrical side wall.

A hollow tube extends through the circular end wall and is positioned substantially along a central axis of the cylindrical side wall. One open end of the tube is connected to the vacuum pump, and the other open end is positioned adjacent the removable cover. The tube has at least one opening therethrough adjacent the interior of the circular end wall so that air and water vapor removed from the drying chamber by the vacuum pump will travel substantially uniformly along the interior cylindrical surface of the condensation chamber to either the open end of the tube or to the at least one opening of the tube thereby allowing uniform condensation and freezing of the moisture from the air on the cooled interior surface of the condensation chamber.

To further assure uniform flow of the air and water vapor over the cooled interior surface of the condensation chamber, a cylindrically shaped baffle member having one open end and one closed end can be positioned around the tube adjacent the at least one opening so that the open end is directed towards the circular end wall. In this manner, only air in the proximity of the circular end wall can enter the at least one opening thereby assuring that the air and water vapor flows along the interior surface of the condensation chamber.

Thus, it is a principal object of the present invention to provide improved apparatus for freeze drying moisture-containing objects having a condensation chamber which permits uniform condensation and freezing of sublimated moisture along the cool interior surfaces thereof.

Another object of the present invention is to provide a unique means of evacuating the air from a condensation chamber in freeze drying equipment to facilitate uniform distribution of frozen condensation in the condensation chamber.

These and other objects, advantages and features shall hereinafter appear, and for the purposes of illustration, but not for limitation, an exemplary embodiment of the present invention is illustrated in the accompanying drawing and detailed description.

DETAILED DESCRIPTION OF THE INVENTION

Figure 1:
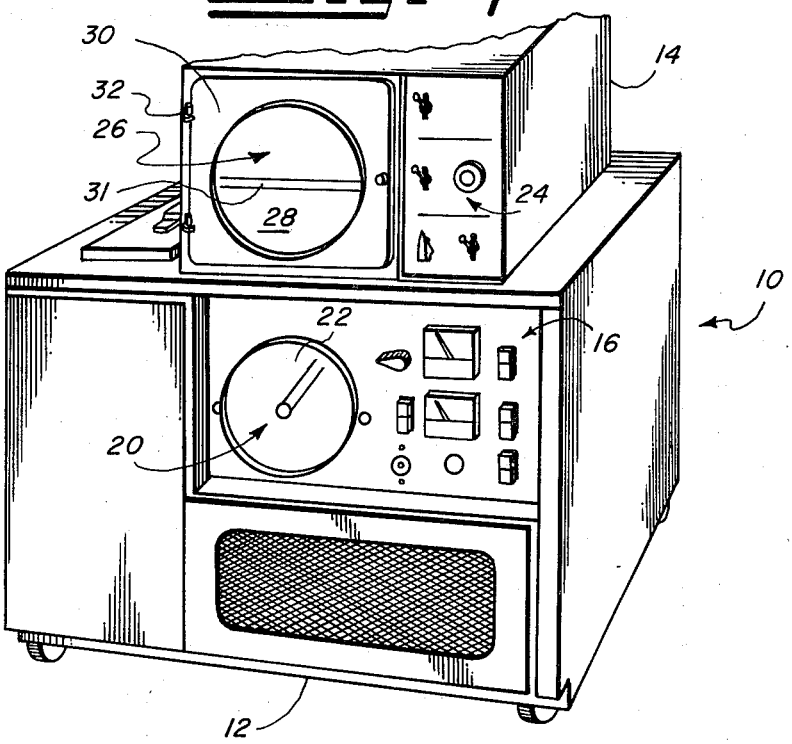
FIG. 1 discloses a freeze drying apparatus containing the novel condensation chamber of the present invention.

With reference to FIG. 1, freeze drying apparatus 10 comprises a base unit 12 and a drying unit 14 mounted on the top of the base unit 12. Base unit 12 comprises a control panel 16 which controls a refrigeration unit (not shown) mounted within the base unit 12 and a vacuum pump (not shown) also incorporated into the base unit 12. Base unit 12 also includes a condensation chamber 20 that has a removable clear lucite plastic cover 22 that seals the end of condensation chamber 20. Cover 22 is removable to permit access to the interior of the condensation chamber to allow removal of frozen moisture as will be more fully discussed below.

Drying unit 14 comprises a control panel 24 and a drying chamber 26 viewable through a clear plastic window 28 in door 30. Door 30 is mounted on hinges 32 which allow the door 30 to be opened to permit insertion of moisture-containing items or materials (not shown) that are to be dried. A shelf 31 is provided to support the items in the drying chamber 26. When closed, door 30 seals the drying chamber to assure that the drying chamber is vacuum tight. Control panel 24 may be utilized to regulate the amount of heat applied to the moisture-contained items in the drying chamber 26.

Figure 2:
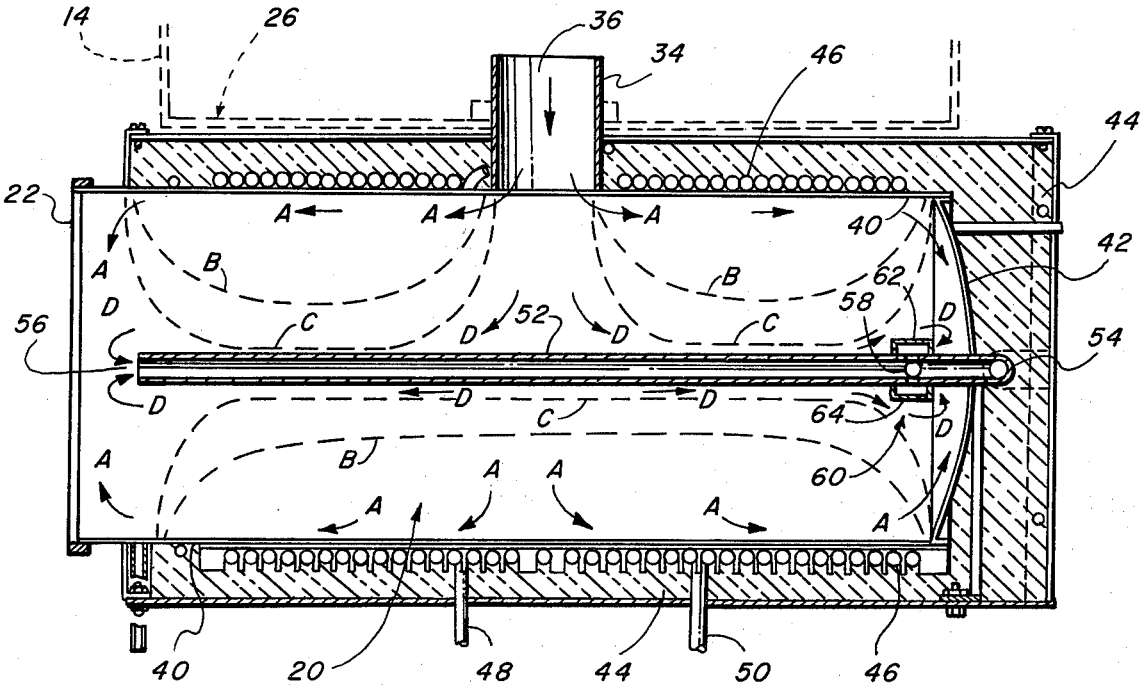
FIG. 2 depicts, in cross-section, the novel condensation chamber in the present invention and further depicts air current flow in the condensation chamber occuring during various operations of the freeze drying apparatus.

With reference to FIG. 2, drying unit 14 is illustrated in dotted lines. A hollow cylindrically shaped port 34 extends from condensation chamber 20 into drying chamber 26 so that the hollow interior 36 of intake port 34 communicates between the drying chamber 26 and condensation chamber 20. Condensation chamber 20 comprises a hollow cylindrical side wall 40 which is sealed at one end by a circular partially hemispherical end wall 42. The other end of cylindrical side wall 40 is closed by clear cover 22.

Surrounding cylindrical side wall 40 and circular end wall 42 of condensation chamber 20 is thermal insulation 44. Refrigeration tube coil 46 is wrapped around the exterior of cylindrical side wall 40 and an evaporating refrigerant material is circulated through the refrigeration tube coil 46 from a refrigeration compressor in base unit 12 (not shown) connected to one end 48 of the refrigeration coil tubing. The other end 50 of the refrigeration tube coil 46 returns the refrigerant to the refrigeration system. Thus, the refrigeration tube coil 46 cools the interior surface of the condensation chamber 20 to a temperature substantially below the freezing point of any moisture that may be present in the condensation chamber 20.

Extending through circular end wall 42 at approximately the center thereof is hollow tubular member 52. Exterior of circular end wall 42, hollow tubular member 52 has a 90° bend at point 54 and that end thereof is connected to the vacuum pump (not shown) in the base unit 12. The hollow tubular member 52 extends within condensation chamber 20 essentially along the central axis of condensation chamber 20 and the other open end 56 of tubular member 52 is positioned adjacent cover 22. Tubular member 52 has four openings or holes 58 through the tubular member at a position immediately adjacent circular end wall 42. Positioned around tubular member 52 and partially over holes 58 is a cup-shaped baffle member 60. Baffle member 60 has a cylindrical wall 62 and a circular end wall 64 joined thereto so that an open end of baffle member 60 faces circular end wall 42.

Operation of improved condensation chamber 20 will now be described in detail. Assuming that there is some frozen moisture-containing item or material within the drying chamber 26, operation of the vacuum pump is initiated so that the air is evacuated from the drying chamber 26 through port 34 to condensation chamber 20. As the atmospheric pressure within the drying chamber is lowered, and as a controlled quantity of heat is applied to the item being dried, the frozen moisture in the item commences to sublimate. The moisture containing air is then pumped through port 36 into condensation chamber 20. Initially, since the vacuum pump is evacuating the air through open end 56 and openings 58 in tubular member 52 the air tends to flow substantially uniformly along the interior surface of cylindrical side wall 40 to the respective ends of the chamber as indicated by arrows A in FIG. 2. Since the cylindrical side wall 40 is cooled below the freezing point by refrigeration coils 46, the moisture in the air tends to condense and freeze on that surface. As more and more moisture is removed from the object being dried, the ice condensation tends to grow as indicated by the dotted lines B in FIG. 2. Since the air being evacuated from the drying chamber tends to flow substantially uniformly along the entire surface of the condensation chamber, the ice tends to be uniformly condensed throughout the entire system until ultimately the ice substantially fills the condensation chamber as indicated by the dotted lines C in FIG. 2 so that the air follows the path of arrows D in FIG. 2. Once the condensation chamber is substantially filled with ice, the condensation chamber must be opened and the ice removed before further drying cycles can be performed.

One of the disadvantages of the prior art has been the non-uniform distribution of ice on the interior surface of the condensation chamber so that air flow is restricted before the condensation chamber volume is filled with ice. For example, if tubular member 52 terminated essentially at the point where it enters through circular end wall 42, all of the air being evacuated from the drying chamber would tend to flow only in the direction of the end wall 42 resulting in the substantial deposit of ice at only one end of the chamber. By comparison, if tubular member 52 were provided without the openings 58, the air would tend to flow the opposite direction resulting in nonuniform distribution of the ice towards the front of the condensation chamber 20. However, by controlling the size of the openings 58 to produce a substantially uniform flow of air to both open end 56 and openings 58, a substantially equal distribution of the ice can be achieved on the interior surfaces of the condensation chamber 20.

Further, the cylindrical shaped baffle member 62 aids in assuring equal ice distribution by causing only air immediately adjacent the circular wall 42 to be aspirated into the tubular member thereby assuring air flow essentially along the interior surface of cylindrical wall 40 and circular end wall 42.

The position of intake port 36 is substantially dicated by the arrangement of the drying chamber 26. Thus, it is desirable to keep the intake port centrally located to both the drying chamber and the condensation chamber. Accordingly, the present invention substantially improves the distribution of condensed ice on the interior of the condensation chamber 20. The tubular member 52 provides a means for causing the air evaporated from the drying chamber to flow substantially equally and uniformly over the entire cooled hollow interior surface of chamber 20 so that the moisture will freeze substantially uniformly on the interior surface of the condensation chamber 20 thereby maximizing moisture removal capabilities of the equipment.

It should be specifically recognized that the principals of the present invention are not limited to any particular type or arrangement of freeze drying equipment. The present invention could be utilized with any number of types of freeze drying equipment without departing from the spirit and scope of the present invention as defined in the appended claims.

I claim:

1. In apparatus for freeze drying moisture containing items of the type including a sealable vacuum tight drying chamber for holding the moisture containing item, a hollow vacuum-tight condensation chamber communicating with the drying chamber, a means for supplying heat to the drying chamber, a vacuum pump communicating with the condensation chamber for evacuating air from the drying chamber through the condensation chamber, a refrigeration compressor, refrigeration coils connected to the refrigeration compressor, the refrigeration coils being positioned around the condensation chamber to cool the hollow interior of the condensation chamber; wherein the improvement comprises:

means for causing air evacuated from the drying chamber to flow substantially uniformly over the entire cooled hollow interior of the condensation chamber so that moisture sublimated from the moisture-containing item will freeze substantially uniformly on the hollow interior of the condensation chamber thereby maximizing moisture removal for the volume of the condensation chamber before there is a necessity for removal of the frozen moisture from the condensation chamber.

2. An improvement, as claimed in claim 1, wherein said means for causing comprises:

a hollow tube communicating at one open end with the vacuum pump and extending through a wall of the condensation chamber into the hollow interior thereof, said tube extending substantially along an axis of the condensation chamber so that the other open end is adjacent another wall of the condensation chamber, said tube having at least one opening along the length thereof immediately adjacent the wall of the condensation chamber through which the tube extends so that air evacuated from the drying chamber can flow along the hollow interior of said condensation chamber to enter either the open end of said tube or said at least one opening.

3. In apparatus for freeze drying moisture-containing items of the type including a sealable vacuum-tight drying chamber, means for supplying heat to the drying chamber, a vacuum pump for reducing the atmospheric pressure in the drying chamber by removing air therefrom and a refrigeration compressor and refrigeration coils connected thereto; wherein the improvement comprises:

a hollow condensation chamber having a cylindrical side wall, a circular end wall sealing one end of the cylindrical side wall, and a removable cover sealing the other end of said cylindrical side wall, said condensation chamber communicating with the drying chamber through a port through the cylindrical side wall intermediate of the ends thereof, and the refrigeration coils being positioned around said cylindrical side wall to cool said cylindrical side wall;

a hollow tube extending through said circular end wall and positioned substantially along a central axis of said cylindrical side wall, one open end of said tube connected with the vacuum pump, the other open end of said tube positioned adjacent said removable cover, said tube having at least one opening through said tube adjacent the interior of said circular end wall so that air removed from the drying chamber by the vacuum pump will travel substantially uniformly along the interior surface of said condensation chamber to the open end of said tube and to said at least one opening through said tube thereby allowing uniform condensation and freezing of moisture from the air.

4. An improvement, as claimed in claim 3, further comprising a cylindrical shaped baffle member having one open end and one closed end positioned around said tube adjacent said at least one opening, said one open end of said baffle member facing said circular end wall so that only air in the proximity of said circular end wall can enter said at least one opening.

* * * * *

UNITED STATES PATENT AND TRADEMARK OFFICE

CERTIFICATE OF CORRECTION

PATENT NO. : 4,178,697

DATED : December 18,1979

INVENTOR(S) : David T. Sutherland

It is certified that error appears in the above-identified patent and that said Letters Patent are hereby corrected as shown below:

In caption to patent: entry No. [73] Assignee: "The Virtis Company," should read --The Virtis Company, Inc.--

Column 2, line 1, "for" should read --of--

Signed and Sealed this

*Twenty-ninth* Day of *April 1980*

[SEAL]

*Attest:*

SIDNEY A. DIAMOND

*Attesting Officer*

*Commissioner of Patents and Trademarks*